US011571668B2

(12) United States Patent
Han et al.

(10) Patent No.: US 11,571,668 B2
(45) Date of Patent: Feb. 7, 2023

(54) APPARATUS AND METHOD FOR MANUFACTURING INSTANTLY EMULSIFIED COSMETICS

(71) Applicant: AMOREPACIFIC CORPORATION, Seoul (KR)

(72) Inventors: Kyung Sup Han, Yongin-si (KR); Jin Nam, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 712 days.

(21) Appl. No.: 16/497,317

(22) PCT Filed: Mar. 26, 2018

(86) PCT No.: PCT/KR2018/003563
§ 371 (c)(1),
(2) Date: Sep. 24, 2019

(87) PCT Pub. No.: WO2018/174693
PCT Pub. Date: Sep. 27, 2018

(65) Prior Publication Data

US 2020/0376449 A1 Dec. 3, 2020

(30) Foreign Application Priority Data

Mar. 24, 2017 (KR) ..... 10-2017-0037725

(51) Int. Cl.
*B01F 23/00* (2022.01)
*B01F 23/41* (2022.01)
(Continued)

(52) U.S. Cl.
CPC ..... *B01F 23/41* (2022.01); *B01F 23/45* (2022.01); *B01F 25/10* (2022.01);
(Continued)

(58) Field of Classification Search
CPC ..... B01F 2025/913; B01F 2101/21; B01F 23/4144
See application file for complete search history.

(56) References Cited

U.S. PATENT DOCUMENTS 6,817,753 B2 * 11/2004 Buenger ..... B65D 83/68 222/145.5
7,160,025 B2 1/2007 Ji et al.
(Continued)

FOREIGN PATENT DOCUMENTS

CA 2367391 9/2000
CN 1343143 4/2002
(Continued)

OTHER PUBLICATIONS

Extended European Search Report-European Patent Application No. 18770927.4 dated Nov. 27, 2020.

*Primary Examiner* — Anshu Bhatia
(74) *Attorney, Agent, or Firm* — Cantor Colburn LLP

(57) ABSTRACT

An apparatus and a method for manufacturing instantly emulsified cosmetics is disclosed. The apparatus comprises: a housing; a pump in the housing for discharging an instantly emulsified emulsion outside of the housing; a first container in the housing for storing an internal fluid; a second container in the housing for storing a functional fluid including a functional raw material; a third container in the housing for storing an external fluid; a channel part in the housing for receiving the external fluid, the internal fluid and the functional fluid generate an emulsion; and a tube provides the pump with the emulsion generated in the channel part, wherein the channel part includes: a first channel for mixing the internal fluid and the functional fluid to generate a mixed fluid; and a second channel for mixing the mixed fluid provided from the first channel and the external fluid to generate an emulsion.

15 Claims, 5 Drawing Sheets

(51) Int. Cl.

| | |
|---|---|
| ***B01F 23/45*** | (2022.01) |
| ***B01F 25/10*** | (2022.01) |
| *B01F 23/40* | (2022.01) |
| *B01F 25/00* | (2022.01) |
| *B01F 101/21* | (2022.01) |

(52) U.S. Cl.
CPC ..... *B01F 23/4144* (2022.01); *B01F 23/483* (2022.01); *B01F 2025/913* (2022.01); *B01F 2101/21* (2022.01)

(56) References Cited

U.S. PATENT DOCUMENTS

| | | | | |
|---|---|---|---|---|
| 7,375,140 | B2 | 5/2008 | Higuchi et al. | |
| 8,596,498 | B2 * | 12/2013 | Werner | B05B 11/3083 222/145.5 |
| 2006/0087918 | A1 | 4/2006 | Ji et al. | |
| 2010/0185322 | A1 | 7/2010 | Bylsma et al. | |
| 2013/0330246 | A1 | 12/2013 | Stemmet | |

FOREIGN PATENT DOCUMENTS

| | | |
|---|---|---|
| DE | 19911776 | 9/2000 |
| DE | 19911777 | 9/2000 |
| DE | 102008001312 | 10/2009 |
| EP | 2962751 | 1/2016 |
| JP | 2002538909 | 11/2002 |
| JP | 2002538947 | 11/2002 |
| JP | 2004351417 | 12/2004 |
| JP | 2006247534 | 9/2006 |
| JP | 2006527084 | 11/2006 |
| JP | 2013542051 | 11/2013 |
| KR | 10-2013-0079799 | 7/2013 |
| WO | 9706076 | 2/1997 |

* cited by examiner

【FIG. 1】
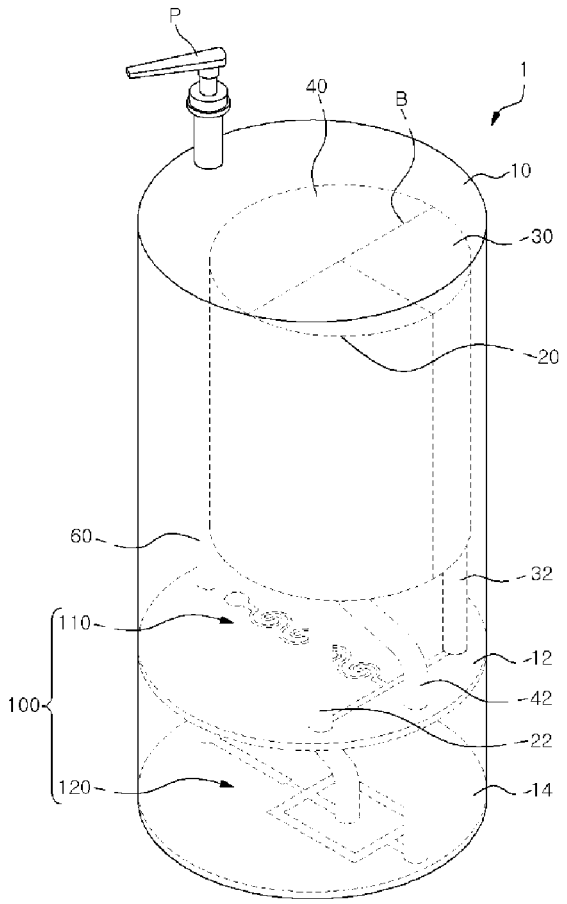

【FIG. 2】
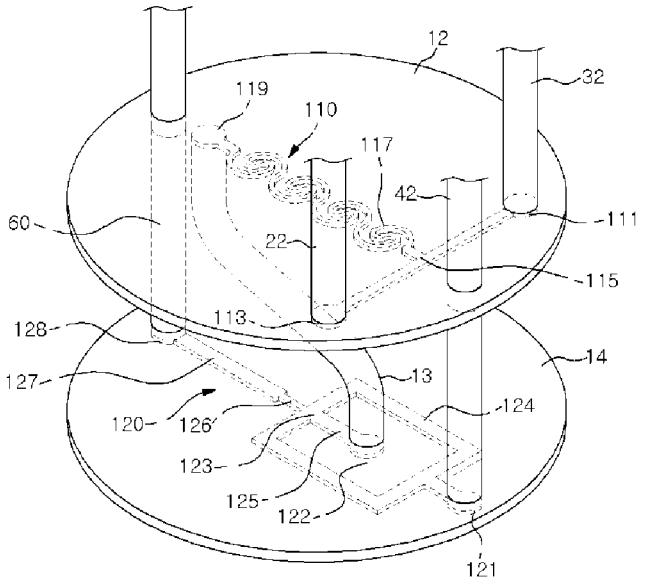

【FIG. 3】
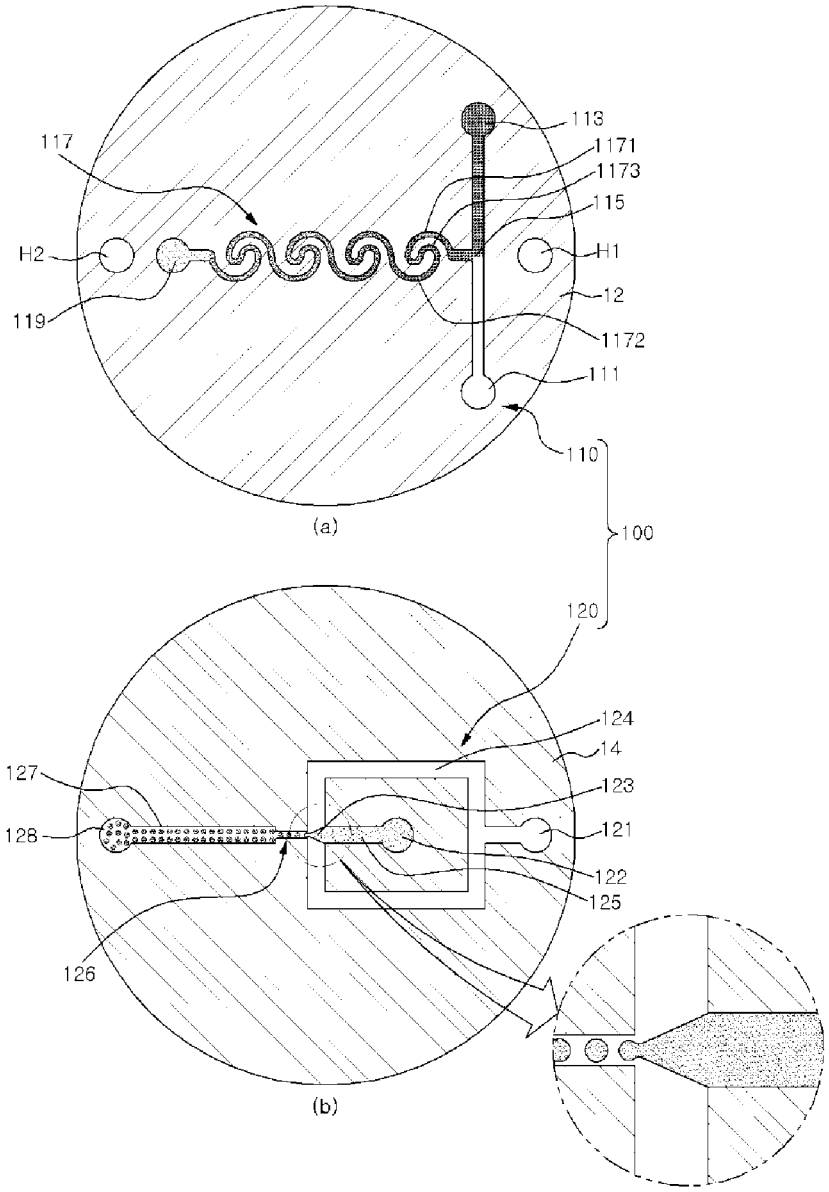

【FIG. 4】
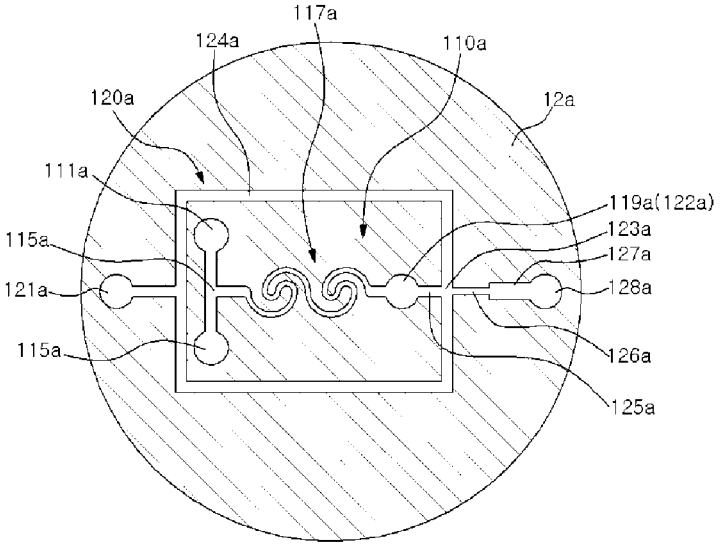

【FIG. 5】
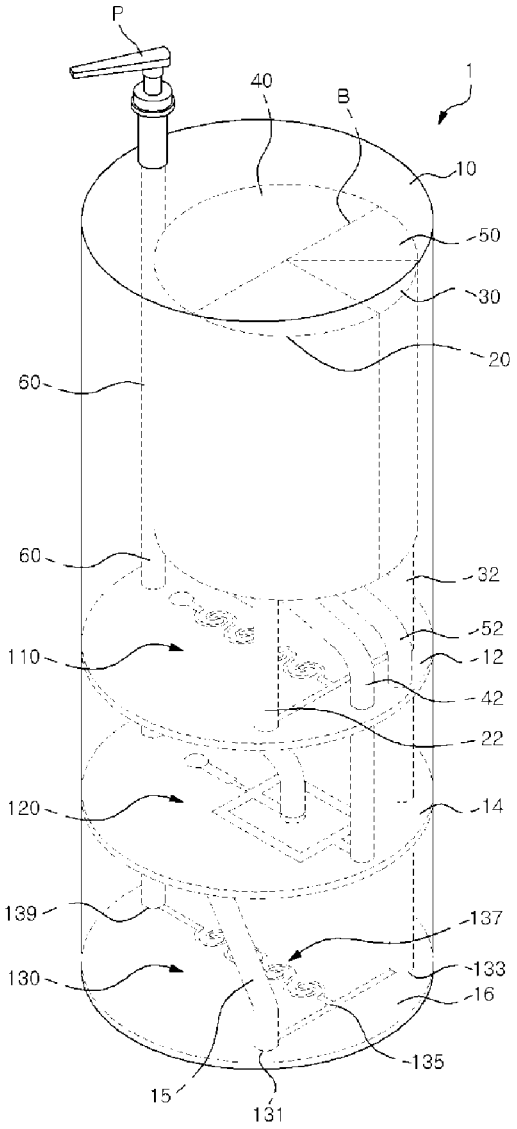

APPARATUS AND METHOD FOR MANUFACTURING INSTANTLY EMULSIFIED COSMETICS

TECHNICAL FIELD

The present invention relates to an apparatus and method for manufacturing instantly emulsified cosmetics.

BACKGROUND ART

The fluid emulsification technique refers to a technique for dispersing one liquid of two fluids that do not mixed with each other, such as water and oil, into small particles and stably dispersing the liquid within the other liquid. Such emulsification techniques are widely used in the manufacturing of cosmetics such as lotions, creams, essences, massage creams, cleansing creams, makeup bases, foundations, eyeliners, mascara, and the like.

Specifically, cosmetics may contain oil in water (O/W) emulsions manufactured by uniformly dispersing a hydrophobic fluid, such as water, within a hydrophilic fluid, such as water in small particle states, or water in oil (W/O) emulsions manufactured by uniformly dispersing a hydrophobic fluid within a hydrophilic fluid in small particle states. In the manufacturing process of such an emulsion, a surfactant or a thickener is used for the purpose of productivity improvement, product quality improvement, and the like. In addition, functional raw materials such as vitamins may be further added to the emulsion to enhance the efficacy as cosmetics.

In order to manufacture an emulsion, it is necessary to properly mix an internal fluid dispersed wherein fine particles are dispersed and an external fluid in continuous phase surrounding the fine particles with each other, however, cosmetics manufactures are making products and selling after manufacturing emulsions in a large quantity in advance as disclosed in Korea Patent No. 10-0222000.

However, the prior art as described above has the following problems.

Cosmetics, including emulsions, can only be used by consumers after being manufactured and sold in online and offline stores through packaging and transportation processes. That is, it takes a long time from the manufacturing time of the emulsion to the actual time of use. Although consumers' desire for fresh cosmetics is growing in the market, such conventional manufacturing and sales method cannot satisfy consumers' needs.

In addition, consumers prefer products that minimize additional substances, such as surfactants, thickeners, or the like, that are chemicals that have little to do with the natural function of cosmetics. However, in order to maintain the stability of the product for a long time expected from manufacturing to use, there is a problem in that additional materials must be used for a certain level or more.

In particular, in functional raw materials for improving the efficacy of cosmetics, there are many materials that are sensitive to acidity (pH), such as vitamin derivatives (AA2G, COS-VCE-K), essential returning pool (ERP), epigallocatechin gallate (EGCG), and the like, or materials that become less effective, discolored, or deodorized over time, such as vitamin C. In order to stably accommodate such materials in cosmetics, cosmetics need be produced under special conditions or they need have a specific condition, however, as a result, side effects may occur, and thus there is a limit in making a high functional product.

For example, the vitamin derivative AA2G has a stable state below pH 4, but cosmetics under such conditions have a problem of low viscosity and long term dosage form stability, and there is also a problem that some customers with sensitive skin feel irritation. Further, in order to prevent vitamin C from react with water, a method of forming a silicone and P/S emulsion particles by heating and dissolving it in a polyol is used, but cosmetics having P/S emulsified particles have a problem in that the feeling of use is sticky therefore customer satisfaction is not high.

That is, in the case of the prior art, despite the advantages of the functional raw material, there is a limitation that the functional raw materials cannot but be used in a limited way.

DISCLOSURE

Technical Problem

Exemplary embodiments of the present invention have been proposed to solve the above problems, and provide an apparatus and method for manufacturing instantly emulsified cosmetics, which can satisfy the consumer's desire for the use of fresh cosmetics.

Further, it is to provide an apparatus and method for manufacturing instantly emulsified cosmetics with reduced content of additional materials used to maintain long term stability of the product.

Further, it is to provide an apparatus and method for manufacturing instantly emulsified cosmetics, which is capable of fully exhibiting the efficacy of the functional raw material.

Technical Solution

According to an aspect of the present invention, there is provided an apparatus for manufacturing instantly emulsified cosmetics comprising: a housing for forming an exterior; a pump provided in the housing for discharging an instantly emulsified emulsion to the outside of the housing; a first container provided in the housing for storing an internal fluid; a second container provided in the housing for storing a functional fluid including a functional raw material; a third container provided in the housing for storing an external fluid; a channel part provided in the housing for receiving the external fluid, the internal fluid and the functional fluid to generate an emulsion; and a tube for providing the pump with the emulsion generated in the channel part, wherein the channel part includes: a first channel for mixing the internal fluid and the functional fluid to generate a mixed fluid; and a second channel for mixing the mixed fluid provided from the first channel and the external fluid to generate an emulsion.

Further, there is provided an apparatus for manufacturing instantly emulsified cosmetics, wherein the first channel and the second channel are disposed in the housing so as to be stacked on each other.

Further, there is provided an apparatus for manufacturing instantly emulsified cosmetics, wherein the first channel is disposed closer to the first container, the second container, and the third container than the second channel.

Further, there is provided an apparatus for manufacturing instantly emulsified cosmetics, further comprising: a first plate on which the first channel is formed; a second plate on which the second channel is formed; and a connecting flow path connecting the first plate and the second plate to supply the mixed fluid generated in the first channel to the second channel.

Further, there is provided an apparatus for manufacturing instantly emulsified cosmetics, wherein the first channel and the second channel are disposed on the same plane.

Further, there is provided an apparatus for manufacturing instantly emulsified cosmetics, further comprising: a first flow path for providing an internal fluid from the first container to the first channel; a second flow path for providing a functional fluid from the second container to the first channel; and a third flow path for providing an external fluid to the second channel from the third container.

Further, there is provided an apparatus for manufacturing instantly emulsified cosmetics, wherein the first channel includes: an internal fluid injection hole connected to the first flow path; a functional fluid injection hole connected to the second flow path; a first confluence portion where the internal fluid provided to the internal fluid injection hole and the functional fluid provided to the functional fluid injection hole meet each other; a mixing portion which advances the internal fluid and the functional fluid that have met each other at the first confluence portion and which generates the mixed fluid; and a first discharging hole configured to provide the mixed fluid generated in the mixing portion to the second channel.

Further, there is provided an apparatus for manufacturing instantly emulsified cosmetics, wherein the mixing portion is formed to make a vortex in the flow by switching the flow direction of the fluid.

Further, there is provided an apparatus for manufacturing instantly emulsified cosmetics, wherein the mixing portion includes: a first rotation path for guiding an entering fluid to be rotated in one direction; a second rotation path for guiding the fluid rotating in one direction to be rotated in another direction; and a direction switching path for changing a rotational direction of the fluid between the first rotation path and the second rotation path.

Further, there is provided an apparatus for manufacturing instantly emulsified cosmetics, wherein the second channel includes: an external fluid injection hole connected to the third flow path; a mixed fluid injection hole through which the mixed fluid supplied from the first channel is injected; a second confluence portion where the external fluid provided to the external fluid injection hole and the mixed fluid injected into the mixed fluid injection hole provided to the mixed fluid injection hole meet each other; an emulsifying part for emulsifying an external fluid and a mixed fluid met at the second confluence portion to generate an emulsion; and a discharging path for guiding an emulsion generated in the emulsifying part to a second discharging hole for providing it to the tube.

Further, there is provided an apparatus for manufacturing instantly emulsified cosmetics, wherein the emulsifying part is configured such that the external fluid interrupts the flow of the mixed fluid such that the mixed fluid is dispersed in the external fluid into a particle state.

Further, there is provided an apparatus for manufacturing instantly emulsified cosmetics, wherein the emulsifying part is an orifice disposed downstream of the second confluence portion.

Further, there is provided an apparatus for manufacturing instantly emulsified cosmetics, wherein the functional fluid includes a vitamin derivative, and has an acidity at which the vitamin derivative is in a stable state, wherein the internal fluid is an aqueous solution having an acidity capable of neutralizing the functional fluid, and wherein the functional fluid is mixed with the internal fluid in the first channel to be neutralized.

Further, there is provided an apparatus for manufacturing instantly emulsified cosmetics, wherein the functional fluid is a polyol in which vitamin C is dissolved, wherein the internal fluid is water, and wherein the functional fluid is mixed with the internal fluid in the first channel to be hydrated.

Further, there is provided an apparatus for manufacturing instantly emulsified cosmetics, further comprising: a fourth container for storing a thickener; and a third channel for mixing the emulsion generated in the second channel with the thickener provided from the fourth container, wherein the tube is connected to the third channel to provide an emulsion mixed with a thickener to the pump.

Further, there is provided an apparatus for manufacturing instantly emulsified cosmetics, wherein the third channel includes: an emulsion injection hole into which the emulsion provided from the second channel is injected; a thickener injection hole through which the thickener is injected; a third confluence portion where the emulsion provided to the emulsion injection hole and the thickener provided to the thickener injection hole meet each other; a thickener mixing portion for advancing the emulsion and the thickener met at the third confluence portion together and mixing them together; and a third discharging hole connected to the tube for discharging the emulsion containing the thickener.

Further, there is provided an apparatus for manufacturing instantly emulsified cosmetics, wherein an internal fluid, a functional fluid, and an external fluid are supplied to the channel part by the pressure generated by the manipulation of the pump, thereby generating the emulsion, and the generated emulsion is supplied to the pump through the tube.

According to another aspect of the present invention, there is provided a method for manufacturing instantly emulsified cosmetics comprising the steps of: manipulating a pump provided in a housing by a user; mixing an internal fluid discharged from a first container provided in the housing and a functional fluid discharged from a second container provided in the housing by the manipulation of the pump to produce a mixed fluid in a first channel; creating an emulsion by mixing the mixed fluid generated in the first channel and an external fluid discharged from a third container together in a second channel to be instantly emulsified; and providing the emulsion generated in the second channel to the pump through a tube connected to the pump.

Advantageous Effects

According to the embodiments of the present invention, the apparatus and method for manufacturing instantly emulsified cosmetics has the advantage that it can satisfy the desire of consumers for the use of fresh cosmetics.

Further, there is an effect that it is possible to provide cosmetics with reduced content of additional materials used to maintain long term stability of the product.

Further, there is an advantage that provides cosmetics that is capable of fully exhibiting the efficacy of the functional raw material.

DESCRIPTION OF DRAWINGS

FIG. 1 is a perspective view schematically illustrating the configuration of an apparatus for manufacturing instantly emulsified cosmetics according to an embodiment of the present invention.

FIG. 2 is a view illustrating the channel part of FIG. 1.

FIG. 3 is a plan cross-sectional view of the first channel and the second channel of FIG. 2.

FIG. 4 is a view illustrating a channel part of an apparatus for manufacturing instantly emulsified cosmetics according to another embodiment of the present invention.

FIG. 5 is a perspective view schematically illustrating the configuration of an apparatus for manufacturing instantly emulsified cosmetics according to yet another embodiment of the present invention.

BEST MODE

Hereinafter, specific embodiments of the present invention will be explained in detail with reference to the drawings.

Additionally, it is noted that the detailed description for known components or functions may be omitted herein so as not to obscure essential points of the disclosure.

FIG. 1 is a perspective view schematically illustrating the configuration of an apparatus for manufacturing instantly emulsified cosmetics according to an embodiment of the present invention; FIG. 2 is a view illustrating the channel part of FIG. 1; and FIG. 3 is a plan cross-sectional view of the first channel and the second channel of FIG. 2.

Referring to FIGS. 1 to 3, an apparatus for manufacturing instantly emulsified cosmetics 1 according to an embodiment of the present invention may generate and provide cosmetic materials to a user at a desired moment.

In the present embodiment, "instantly emulsified" may be understood as the internal fluid is emulsified in the external fluid within a few seconds, thereby enabling the emulsified state to be maintained for a certain time. That is, the apparatus for manufacturing instantly emulsified cosmetics 1 means an apparatus which instantly emulsifies a plurality of raw materials within a few seconds and immediately supplies them to the user.

Specifically, the apparatus for manufacturing instantly emulsified cosmetics 1 according to an embodiment of the present invention may include: a housing 10 for forming an exterior; a pump P provided in the housing 10 for discharging an instantly emulsified emulsion to the outside of the housing 10 by the user's manipulation; a first container 20 provided in the housing 10 for storing an internal fluid; a second container 30 provided in the housing 10 for storing a functional fluid including a functional raw material; a third container 40 provided in the housing 10 for storing an external fluid; a channel part 100 provided in the housing 10 for receiving the external fluid, the internal fluid and the functional fluid to generate an emulsion; and a tube 60 for providing the pump P with the emulsion generated in the channel part 100. In the following description, the functional raw material may be understood as a raw material included for the purpose of improving the function of the cosmetic ingredients, in particular, a raw material that has been legally authorized. In addition, a functional fluid may be understood to mean a fluid in which a functional raw material is dissolved or contained.

The housing 10 may be formed in a predetermined shape capable of accommodating the first container 20, the second container 30, the third container 40, and the channel part 100 in the inner side thereof, and although it is illustrated to be formed in the shape of a cylinder in the present embodiment, the spirit of the present invention is not limited thereto.

The pump P is a means for discharging the fluid from the containers 20, 30, and 40 and instantly emulsifying it and then providing energy for discharging it through a discharge hole formed outside the housing 10, which is arranged on one side of the housing 10, wherein a manipulating part that can be manipulated by a user is exposed toward the outer side of the housing 10, and a connecting part for discharging the mixed fluid to the outside may be provided inside the housing 10. The raw material contained in the first container 20, the second container 30, and the third container 40 is provided to the channel part 100 by the pressure generated by the pump P, and the raw materials supplied to the channel part 100 may be discharged to the pump P through the tube 60 after being instantly emulsified while moving along a predetermined path. To this end, a series of flow paths from the pump P to each of the containers 20, 30, and 40 may be formed for communicating between them.

In this embodiment, while the pump P is described as an example that includes a discharging part that is exposed to the outside of the housing 10 to discharge the cosmetic materials, this is only one example and the spirit of the present invention is not limited thereto. For example, the discharging part may be provided separately from the pump P, and the pump P may be connected to any point of a series of flow paths connected from the containers 20, 30, and 40 to the discharging part to provide pressure.

In this embodiment, the pump P is shown as an example of a push-type pump which applies a negative pressure on the movement path of the fluid inside the housing 10 by the user's action of pressing and releasing the manipulating part. In this case, since the raw material discharging from the containers 20, 30, and 40, the movement in the channel part 100, and the discharging of the cosmetic materials may all be realized by the pressure in a single direction formed by the pump P, there is an advantage that the configuration of the apparatus can be simplified.

However, the spirit of the present invention is not limited thereto, and various types of pumps may be used as the pump P. For example, button-spring pumps, syringe pumps, flexible tube pumps, gear pumps, porous pumps, thread inserting pumps, and the like can be used as non-powered pumps, or a pump for absorbing or discharging fluid by capillary action may be applied by applying an orifice, a roller ball, a pencil, or the like to the discharging port. In addition, as a power pump, a pump for absorbing or discharging the fluid by controlling the electricity, vibration, sound waves, piezoelectric material may be applied.

The first container 20, the second container 30, and the third container 40 may be accommodated inside the housing 10, attached to the outside of the housing 10, or provided in a replaceable form. In the present embodiment, the first container 20, the second container 30, and the third container 40 are illustrated as an example provided by being partitioned by the barrier B in one cylindrical container. At this time, in order for the emulsified particles to be formed, the injection ratio of the external fluid to the internal fluid should generally be equal to or higher, for example, the injection amount of the external fluid may be 1 to 30 times the injection amount of the internal fluid. The third container 40 that stores the fluid may be formed to have a larger volume than other containers.

A first flow path 22 is connected to the first container 20 to supply the internal fluid to the channel part 100, the second flow path 32 is connected to the second container 30 to supply a functional fluid to the channel part 100, and the third flow path 42 is connected to a third container 40 to supply an external fluid to the channel part 100. At this time, the first flow path 22 and the second flow path 32 may have a length and diameter so that the internal fluid and the functional fluid can be simultaneously delivered to the channel part 100, specifically the first channel 110, by the pressure applied by the pump P. In addition, the third flow path 42 may have a length and a diameter in a way that after the internal fluid and the functional fluid are mixed in the first channel 110 and provided and moved to the second channel 120 so that the external fluid can be delivered to the second channel. For example, the third flow path 42 may have a longer length than the first flow path 22 and the second flow path 32 so that the external fluid can reach the channel part 100 later when applied with the same pressure. Here, the first flow path 22, the second flow path 32, and the third flow path 42 respectively supply raw materials of the emulsion to the channel part 100, and may be referred to as supply flow paths.

Here, the connecting portions of the respective containers 20, 30, and 40 and the flow paths 22, 32, and 42 may be provided with opening and closing adjustment means such as a valve may be provided to allow the contents to be discharged into the flow paths 22, 32, and 42 only when the pressure of the pump P is applied.

The channel part 100 may include a first channel 110 for mixing the internal fluid and the functional fluid provided through the first flow path 22 and the second flow path 32 to generate a mixed fluid, and a second channel 120 for mixing the mixed fluid provided from the first channel 110 and the external fluid provided through the third flow path 42 to generate an emulsion. Here, the first channel 110 and the second channel 120 may be understood as a microfluidic channel.

The first channel 110 and the second channel 120 may be understood as a predetermined flow path through which fluid entered into the channel may move, as in the present embodiment, it may be formed inside plates 12 and 14 accommodated in the housing 10. However, the method of providing the first channel 110 and the second channel 120 is not limited thereto, and in some embodiments, the first channel 110 and the second channel 120 may be a tubular body integrally formed to form a flow path, and they may be an assembly formed of a plurality of parts including the flow path being assembled to each other.

In the present embodiment, as illustrated, it will be described as an example that the first channel 110 is formed in the first plate 12 provided in the housing 10, and the second channel 120 is formed in the second plate 14. Specifically, the first plate 12 and the second plate 14 may be disposed in a form of being stacked on the inner side of the housing 10, the first plate 12 is disposed on the upper side, and the second plate 14 may be disposed below the first plate 12. That is, the first channel 110 may be disposed closer to the containers 20, 30, and 40 than the second channel 120. Therefore, the third flow path 42 may have a longer length than the first flow path 22 and the second flow path 32 with a simpler structure. In addition, by forming the first plate 12 and the second plate 14 in a stacked structure, it is possible to increase the space utilization in the housing 10, thereby miniaturizing the size of the overall product.

Meanwhile, the first channel 110 and the second channel 120 may be formed such that the entry point of the fluid is higher than the discharging point so that the fluid can flow smoothly. To this end, the first plate 12 and the second plate 14 may be provided to be inclined toward the direction of travel of the fluid.

Further, in the present embodiment, although it is described as an example wherein the first plate 12 and the second plate 14 are spaced apart a predetermined distance in the vertical direction, and a connecting flow path 13 is provided between the first plate 12 and the second plate 14 in order to transfer the mixed fluid generated in the first plate 12 to the second plate 14, the spirit of the present invention is not limited thereto. For example, the first plate 12 and the second plate 14 may be disposed to be in contact with each other, and the first channel 110 and the second channel 120 may be disposed vertically in one plate. In this case, the connecting flow path 13 may be a flow path provided inside the plate to substantially communicate the first channel 110 and the second channel 120.

The first flow path 22 and the second flow path 32 are connected to the first plate 12 provided with the first channel 110, the second flow path 42 and the tube 60 are connected to the second plate 14 provided with the second channel 120, and the third flow path 42 and the tube 60 may pass through the first plate 12 and extend toward the second plate 14. To this end, a third flow path through hole H1 and a tube through hole H2 may be formed in the first plate 12.

Meanwhile, after molding the first plate 12 and the second plate 14 with separate upper and lower structures, the first plate 12 and the second plate 14 are combined with each other so that the first channel 110 and the second channel 120 may be formed therein, and may then be fixed inner side of the housing 10 by a predetermined fixing means.

The first channel 110 agitates and mixes the internal fluid supplied from the first container 20 along the first flow path 22 and the functional fluid supplied from the second container 30 along the second flow path 32 so as to generate a fluid. Specifically, the first channel 110 may include: an internal fluid injection hole 111 connected to the first flow path 22; a functional fluid injection hole 113 connected to the second flow path 32; a first confluence portion 115 where the internal fluid provided through the internal fluid injection hole 111 and the functional fluid provided through the functional fluid injection hole 113 meet each other; a mixing portion 117 for generating the mixed fluid while advancing the internal fluid and the functional fluid met by the first mixing portion 115; and a first discharging hole 119 connected to the connecting flow path 13 to supply the mixed fluid to the second channel 120. As described above, the internal fluid and the functional fluid are discharged from containers 110, 120, and 130 by the pressure formed in the pump P and passed through the first channel 110, and then may be moved to the second channel 120.

The internal fluid inlet 111 and the functional fluid inlet 113 may be disposed to face each other with respect to the first confluence portion 115, whereby a 'T' shape flow path may be formed around the first confluence portion 115. The internal fluid and the functional fluid contacted by the first confluence portion 115 may enter the mixing portion 117 along a straight flow path in a state not being sufficiently mixed with each other.

The mixing portion 117 is a flow path capable of making a vortex in the flow by changing the direction of travel of the fluid. To this end, the mixing portion 117 may include a bent part, a curved part, a rotating part, and the like so that the traveling direction of the fluid can be switched. In particular, when the mixing portion 117 is formed to be able to rotate the fluid in unidirectional or in a bidirectional, a vortex is made in the fluid flow and at the same time the centrifugal force applied to the fluid therefore the fluid passing through the mixing portion 117 can be sufficiently mixed.

In this embodiment, the mixing portion 117 configured to rotate the fluid entering the one direction (counterclockwise direction with reference to the drawing) and then again to another direction (clockwise direction with reference to the drawing) will be described as an example. In detail, the mixing portion 117 may include: a first rotation path 1171 for guiding the fluid to rotate in one direction; a second rotation path 1172 for guiding the fluid rotated in one direction to rotate in the other direction; and a direction switching path 1173 for changing the rotation direction of the fluid between the first rotation path 1171 and the second rotation path 1172. The internal fluid and the functional fluid in contact with each other and not sufficiently mixed in the first confluence portion 115 move along the first rotation path 1171 and are rotated and mixed in one direction, and since the rotation direction is switched in the direction switching path 1173 and rotated in the other direction again therefore the internal fluid and the functional fluid can be actively mixed.

The plurality of mixing portions 117 may be arranged in series so that the internal fluid and the functional fluid may be sufficiently mixed. In the present embodiment, four mixing portions 117 are successively disposed on the first channel 110 as an example, but the number and arrangement of the mixing portion 117 do not limit the spirit of the present invention.

On the other hand, in the present embodiment, while the mixing portion 117 has been described as an example to promote the mixing by switching the direction of flow of the fluid to make a vortex, the method of mixing the fluid is not limited thereto. For example, a variety of methods may be used, such as a method for increasing the contact area by stacking two fluids, a method for applying an electric field, and a method for using sound wave, as well as a method that can be agitated inside other microfluidic channels.

The internal fluid and the functional fluid are sufficiently mixed while passing through the mixing portion 117, and the fluid being mixed as described above is called a mixed fluid in this embodiment. The mixed fluid is moved to a first discharging hole 119 and provided to the second channel 120 through the connecting flow path 13.

The second channel 120 agitates the mixed fluid supplied from the first channel 110 along the connecting flow path 13 and the external fluid supplied from the third container 40 along the third channel 42, thereby generating an emulsion which is an emulsified material. Here, the mixed fluid containing the internal fluid and the external fluid may be emulsified for a very short time passing through the second channel 120 to become an emulsion. That is, the mixed fluid and the external fluid are instantly emulsified. In this case, the mixed fluid may be dispersed in a state of particles inside the external fluid as it is mixed with the internal fluid and the functional fluid by the instant emulsification in the second channel 120. As described above, the mixed fluid and the external fluid may flow into the second channel 120 from the first channel 110 by the pressure formed in the pump P, and may move through the second channel 120 to the tube 60.

The second channel 120 may include: an external fluid injection hole 121 connected to the third flow path 42; a mixed fluid injection hole 122 connected to the connecting flow path 13 and into which a mixed fluid supplied from the first channel 110 is injected; a second confluence portion 123 in which the external fluid and the mixed fluid meet each other; an emulsifying part 126 for emulsifying the external fluid and the mixed fluid met by the second confluence portion 123 to generate an emulsion; and a discharging path 127 for guiding the emulsion to the second discharging hole 128 connected to the tube 60.

The external fluid introduced into the second channel 120 through the external fluid injection hole 121 is guided to the second confluence portion 123 along the external fluid movement path 124 branched to both sides, and the mixed fluid introduced into the second channel 120 through the mixed fluid injection hole 122 may be guided to the second confluence portion 123 along a single mixed fluid moving path 125. At this time, the flow direction of the mixed fluid flowing into the second confluence portion 123 and the moving direction to the emulsifying part 126 and the flow direction of the external fluid flowing into the second confluence portion 123 may be perpendicular to each other, and the external fluid may be introduced from both sides (the upper side and the lower side with reference to FIG. 3) of the mixed fluid that is moved in one direction (the left side with reference to FIG. 3) and may join the mixed fluid. That is, around the second confluence portion 123, the mixed fluid movement path 125, the emulsifying part 126, and the external fluid movement path 124 may have a '+' shape. Due to this, the flow of the mixed fluid is forced from both sides of the advancing direction, and as a result, the flow becomes thinner, so that the emulsifying reaction at the emulsifying part 126 can be more easily performed.

The emulsifying part 126 functions to allow the external fluid to cut the flow of the mixed fluid so that the mixed fluid is dispersed in the external fluid in a state of particles. In this embodiment, an example will be described in which an orifice disposed at the downstream of the second confluence portion 123 and whose width is getting narrower in the advancing direction of the fluid is provided as the emulsifying part 126. For example, the emulsifying part 126 may be formed as an orifice and have a smaller width than the mixed fluid movement path 125 and the discharging path 127.

The external fluid passes through a relatively narrow orifice and applies a shear force on the mixed fluid in the direction in which the narrowing direction of the inner side of the orifice (vertical direction) and the flow direction of fluid flow (horizontal direction) are combined (the diagonal direction conversing toward the center of the orifice). By virtue of this force and the geometry of the corners of the orifice inlet, the flow of movement of the mixed fluid is interrupted and becomes particle shape. Capillary instability increases when two non-mixing fluids pass through an orifice with an unstable interface, and the flow of mixed fluid can be interrupted with less energy than a channel without an orifice. The broken mixed fluid becomes spherical shape to maintain a stable state and is dispersed in the external fluid.

The emulsification method using the orifice as in this embodiment may be referred to as flow-focusing emulsification, in which the fluids of different phases are allowed to flow in the same direction, but the orifices located at the confluence portion cause the external fluid to stop the flow of the internal fluid (Flow-Focusing method). Using the orifice as described above, the flow of the external fluid may be changed in the diagonal direction inside the orifice and allow a stronger shear force to deliver to the mixed fluid, resulting in the formation of emulsified particles of a certain size at the same time as the emulsified particles are more easily formed.

In addition, various embodiments may be applied to the emulsifying part 126, for examples, a method of emulsification while moving the fluids of different phases in the same direction (Co-Flow method), a method of emulsification while moving so that fluids of different phases can intersect (cross-flow method), a method of forming emulsified particles in the confluence portion by controlling the aspect ratio of the inlet of the external fluid and the inlet of the internal fluid toward the confluence portion to be large or low (Step Emulsification method), and a method of forming emulsified particles by passing an internal fluid or a mixed fluid of two phases through a hole of a membrane (Membrane Emulsification method) can be used.

In addition, the emulsifying part 126 may use a power source, for example, a channel of a method in which emulsified particles are formed by using any one or more of an electrical field, a magnetic field, a centrifugal control, an optical control, a vibration control, and a piezoelectric material (piezoelectric control) may be used.

In addition, the emulsifying part 126 may change the viscosity, interfacial tension, and wettability of the fluid to form emulsified particles, for example, electrorheological (ER) or magnetorheological (MR) fluids, photo-sensitive fluids may be applied.

The emulsion formed in the emulsifying part 126 may be stabilized while passing through the discharging path 127, and may be delivered to the tube 60 through the emulsion discharging hole 128. Here, the inner wall of discharging path 127 may be provided to have a property corresponding to the hydrophilicity of the external fluid. In this case, the external fluid constituting the outer phase of the emulsion is attracted to the inner wall side of the discharging path 127, and the mixed fluid relatively moves away from the inner wall side of the discharging path 127, the emulsion state remains stable and can be moved. For example, when the external fluid is an oil, the inner wall of the discharging path 127 may be coated with a hydrophobic material or a hydrophobic film, and when the external fluid is water, it may be coated with a hydrophilic material or a hydrophilic film. Here, a material having a contact angle with water of 0 to 50 degrees may be used as the hydrophilic material or a hydrophilic film, and a material having a contact angle with water of 70 degrees to 120 degrees may be used as the hydrophobic material or the hydrophobic film.

According to the embodiment, not only the discharging path 127 but also other components of the emulsifying part 126 and the second channel 120 may be formed to have properties corresponding to the hydrophilicity of the external fluid.

In a prior art, since the external fluid and the internal fluid have high interfacial tension and do not easily mix with each other, it was quite difficult to form and maintain emulsified particles without using an excessive amount of surfactant (1% to 5%). However, according to the present embodiment, since the influence of the surface force on the fluid in the second channel 120 having the extremely small length (less than millimeter) is significantly larger than the body force, the surfactant and the like, there is an advantage that the emulsifying reaction may be achieved quickly by not using a surfactant or the like or adding a minimum amount. In addition, the principle in which any one of the two fluids that do not easily mix with each other to break the flow of the other fluid to form the emulsified particles also helps reduce the surfactant.

Meanwhile, in the present embodiment, the emulsifying part 126 is provided as an example on the downstream side of the second confluence portion 123, however, according to the embodiment, the emulsifying part 126 may be a peripheral configuration forming the second confluence portion 123 or may be substantially the same as the second confluence portion 123. For example, the mixed fluid may be supplied at a predetermined angle to the external fluid flowing in a straight line, and may be broken by the geometric shape of the point where the mixed fluid movement path and the external fluid movement path meet and are dispersed in the external fluid, but in this case, the point where the mixed fluid movement path and the external fluid movement path (for example, a corner portion where two paths meet) functions as an emulsifying part.

Further, in the present embodiment, the discharging path 127 is separately provided on the downstream side of the emulsifying part 126, but the discharging path 127 may be removed according to the embodiment, or it may be formed continuously with the emulsifying part 126, and the boundary thereof may not be specified.

The tube 60 provides the emulsion to the pump P so that the emulsion can be finally discharged to the user through the discharging hole of the pump P, and it may be formed of a transparent material so that the user can check the emulsified material moving through the tube 60 from the outside. Of course, a part of the housing 10 in the region corresponding to the tube 60 may also be formed of a transparent material.

As described above, from the pump P to each of the containers 20, 30, and 40 there are formed a series of flow paths which communicate with each other, and the series of flow paths may include a tube 60, a second channel 120, a connecting flow path 13, a first channel 110, and a supply flow path 22, 32, and 42.

In this regard, the pressure of the pump (P), the diameter of the supply flow paths 22, 32, and 42 and the connecting flow path 13, the length, the respective injection holes, paths constituting the first channel 110 and the second channel 120, the width, depth, size, and the like of the discharging holes may be adjusted to generate an amount of cosmetic materials that can be used once by a user by the single manipulation of the pump P. Specifically, in order to determine the amount of cosmetic materials that can be used once, the composition ratio of the internal fluid, the external fluid, and the functional fluid should be determined, and the structural characteristics of the respective components may be set according to a predetermined calculation formula accordingly. In addition, the third flow path 42 is supplied to the second channel 120 after the mixed fluid is generated in the first channel 110, and it may be configured in a way that at the time it is arrived at the second confluence portion 123, the external fluid may be supplied to the second channel 120 so as to be arrived at the second confluence 123.

Since the amount of the single use of cosmetics is about several ml, the amount of fluids discharged from each of the containers 20, 30, and 40 can be set smaller than that, so that the time for passing through the channel part 100 is set very short therefore instantaneous emulsification can be implemented more easily.

Meanwhile, the size and content of emulsified particles are an important factor in determining the quality of cosmetics. In order to control the size and content of the emulsified material, a method of adjusting the amount of the surfactant added to the emulsified material was used in a prior art. However, in the present embodiment, the size and content of the emulsified materials may be adjusted by adjusting the structural elements and fluid flow conditions of the channel part 100, especially the second channel 120. For example, the structural elements of the channel may be the height of the channel, the width of the orifice, the width of the injection hole of each fluid, and the like, and the flow conditions of the fluids may be the strength of negative pressure, the ratio of the flow rates of the fluids, the viscosity ratio of the fluids, and the like. At this time, the size of the emulsified particles becomes smaller as the height of the channel becomes lower, the orifice becomes narrower, the intensity of negative pressure becomes stronger, the flow rate ratio of the external fluid to the internal fluid becomes larger, and the viscosity of the internal fluid compared to the external fluid becomes higher, but under the conditions opposite to those above, the size of the emulsified particles becomes larger.

Further, a small amount of surfactant may be added to the internal fluid or the external fluid to assist in forming the emulsified particles, depending on the type of emulsion to be generated. For example, in the case of generating an O/W emulsion, a small amount of a surfactant having a hydrophile-lipophile balance (HLB) value of greater than 7, preferably 8 to 16, may be added, and in the case of generating an W/O emulsion, a small amount of a surfactant having a HLB value of 7 balaks, preferably 3 to 6, may be added.

Hereinafter the operation and effect of the apparatus for manufacturing instantly emulsified cosmetics 1 according to an embodiment of the present invention having the configuration as described above will be described.

PH-sensitive functional raw materials, such as vitamin derivatives (AA2G, COS-VCE-K), essential returning pool (ERP), and epigallocatechin gallate (EGCG), remain stable below a specific pH. Therefore, functional fluids where these functional raw materials are dissolved is stored in a second container 30 with pH adjusted. For example, the functional fluid stored in the second container 30 may have a pH of 4 or less. In this case, an aqueous solution having an acidity capable of neutralizing the functional fluid stored in the second container 30 may be supplied to the first container 20 as the internal fluid. In addition, the third container 40 may be supplied with oil as an external fluid.

When the user manipulates the pump P to generate negative pressure in the tube 60, the channel part 100, and the supply flow paths 22, 32, and 42, the raw materials stored in the respective containers are supplied to the channel part 100.

First, the internal fluid stored in the first container 20 and the functional fluid stored in the second container 30 are respectively supplied to the first channel 110 along the first flow path 22 and the second flow path 32.

The internal fluid and the functional fluid supplied to the injection holes 111 and 113 of the first channel 110 may meet at the first confluence portion 115 together and pass through the mixing portion 117 and be agitated with each other. By virtue of the vortex generated while passing through the mixing portion 117, the internal fluid and the functional fluid can be mixed more smoothly. At this time, the functional fluid may be neutralized while being mixed with the internal fluid.

The internal fluid and the functional fluid become a mixed fluid while passing through the mixing portion 117, and the mixed fluid is provided to the connecting flow path 13 through the first discharging hole 119.

The mixed fluid provided to the connecting flow path 13 is moved to the second channel 120 to be mixed with the external fluid and emulsified. Specifically, the mixed fluid delivered to the mixed fluid injection hole 122 of the second channel 120 meets the external fluid at the second confluence portion 123 delivered to the external fluid injection hole 121 through the third flow path 42, and passes through an orifice provided as emulsifying part 126 and is broken into particles and dispersed in the external fluid.

In this way, the emulsion formed in the emulsifying part 126 is moved to the second discharging hole 128 along the discharging path 127 and may be discharged to the pump P through the tube 60.

In this process, the functional raw material becomes unstable as the functional fluid is neutralized in such a process, but this unstable state only lasts for a very short period of time until the functional fluid is mixed with the internal fluid and discharged through the pump 60 via the second channel 120, through the tube 20, through the tube P, so the efficacy of the functional raw materials can be exhibited at substantially the same level as when in a stable state.

Further, since the functional fluid is neutralized, the generated emulsion can be used without special irritation even if used by a user having a sensitive skin.

On the other hand, functional raw materials, such as vitamin C, that become less effective, discolored or deodorized over time when decomposed in water, cannot be dissolved in water, so they can be heated and dissolved in polyols and stored in a second container 30. In this case, the first container 20 may be supplied with water capable of hydrating the functional fluid stored in the second container 30 as an internal fluid, and the third container 40 may be supplied with oil as an external fluid.

When the user manipulates the pump P, the water stored in the first container 20 and the functional fluid stored in the second container 30 may be supplied to the first channel 110, and the functional fluid may be hydrated while passing through the mixing portion 117. The mixed fluid thus formed may be delivered to the second channel 120, mixed with the external fluid and emulsified, and then may be provided to the pump P through the tube 60.

Even though the functional raw materials become unstable as the functional fluid is hydrated in such process, such an unstable state only lasts for a very short period of time until the functional fluid is mixed with the internal fluid and discharged through the pump 60 via the second channel 120, through the tube 20, through the tube P, so the efficacy of the functional raw materials can be exhibited at substantially the same level as when in a stable state.

Further, since the functional fluid is hydrated, customer satisfaction may be improved because it does not give a sticky feeling as in the conventional cosmetics containing vitamin C.

On the other hand, the above described embodiments have been described in which water is used as the internal fluid and oil is used as the external fluid to generate a W/O emulsion as an example, but it is also possible to generate O/W emulsion in which oil is used as the internal fluid and water is used as the external fluid.

In addition, in the present embodiment, water and oil have been described as examples of an internal fluid and an external fluid, but these are described as representative examples of hydrophilic fluids and hydrophobic fluids, any hydrophilic or hydrophobic fluid capable of generating an emulsion may be used as the internal fluid and the external fluid.

According to the apparatus for manufacturing instantly emulsified cosmetics 1 and the method therefor according to an embodiment of the present invention as described above, through the use of the functional raw materials, the functional raw materials can be included in the emulsion in a state where the limitations of the conventional cosmetics are excluded. Therefore, it can be included in the cosmetics so that the efficacy of the functional raw materials can be sufficiently exhibited, the user has an advantage that can fully obtain the efficacy of the functional raw materials.

In addition, when the user manipulates the pump P, it is to use the cosmetics that are instantly manufactured and provided therefore it is possible to use fresh cosmetics compared to the cosmetics manufactured and sold in large quantities by cosmetics manufacturers.

In addition, since the use of a surfactant or a thickener in consideration of the long-term stability of the cosmetics can be minimized, the user can use cosmetics with a minimum content of additional substances.

Hereinafter the channel part of the apparatus for manufacturing instantly emulsified cosmetics according to another embodiment of the present invention will be described with reference to FIG. 4. However, since the embodiment of FIG. 4 has a difference in that the first channel and the second channel are implemented on the same plane as compared to the above described embodiment, the difference will be mainly described, and the description and the reference numerals of the above described embodiment will be used to describe the same part.

FIG. 4 is a view illustrating a channel part of the apparatus for manufacturing instantly emulsified cosmetics according to another embodiment of the present invention.

Referring to FIG. 4, a first channel 110*a* and a second channel 120*a* may be implemented on the same plane. That is, the first channel 110*a* and the second channel 120*a* may be formed side by side instead of being stacked with each other or being formed to have a height difference. For example, one plate 12*a* may be provided in the housing 10, and the first channel 110*a* and the second channel 120*a* may be formed on the one plate 12*a*.

The internal fluid injection hole 111*a* of the first channel 110*a*, the functional fluid injection hole 113*a*, the first confluence portion 115*a*, and the mixing portion 117*a* correspond to the configuration of the first channel 110 of the above described embodiment, and the outer phase injection hole 121*a*, the mixed fluid injection hole 122*a*, the second confluence portion 123*a*, the emulsifying part 126*a*, and the emulsion discharging hole 128*a* of the second channel 120*a* substantially correspond to the configuration of the second channel 120 of the above described embodiment therefore a detailed description thereof will be omitted. In this embodiment, however, it is illustrated that two mixing portions 117*a* are provided.

In this embodiment, the mixed fluid discharging hole 119*a* of the first channel 110*a* will be functioned as the mixed fluid injection hole 122*a* of the second channel 120*a*. That is, the mixed fluid movement path 125*a* of the second channel 120*a* may be directly connected to the mixed fluid discharging hole 119*a*, and the mixed fluid discharged through the mixed fluid discharging hole 119*a* may be provided directly to the second confluence portion 123*a* along the mixed fluid movement path 125*a*.

According to the present embodiment, since both channels 110*a* and 120*a* are implemented using one plate 12*a*, there is an advantage in that the overall height of the manufacturing apparatus may be lowered. In addition, since the connecting flow path 13 is removed, the moving distance between the internal fluid and the functional fluid may be reduced, the product may be designed more simply and easily, and the time taken for emulsion to be discharged after pressurizing the pump P may be shortened.

Hereinafter the channel part of the apparatus for manufacturing instantly emulsified cosmetics according to another embodiment of the present invention will be described with reference to FIG. 5. However, since the embodiment of FIG. 5 is different from the embodiment of FIG. 1 in that a fourth container for storing the thickener and a third channel for mixing the thickener and the emulsion are further provided, the difference will be mainly described, and the description and the reference numerals of the first embodiment will be used to describe the same part.

FIG. 5 is a perspective view schematically illustrating the configuration of an apparatus for manufacturing instantly emulsified cosmetics according to yet another embodiment of the present invention.

Referring to FIG. 5, an apparatus for manufacturing instantly emulsified cosmetics 1*b* according to another embodiment of the present invention may be provided with a fourth container 50 for storing a thickener and a fourth flow path 52 for guiding the thickener stored in the fourth container 50 to the channel part 100*b*.

The thickener may be added to the emulsion to improve the usability and stability of the emulsion, and may be provided to be mixed with the emulsion after the emulsion is generated in the second channel 120.

As illustrated in the drawing, the fourth container 50 may be provided in a form in which one cylindrical container is partitioned so that the first container 20 to the fourth container 50 are provided. However, the spirit of the present invention is not limited thereto, and may be provided independently of the other containers 20, 30, and 40 and fixed to the housing 10 separately, or may be provided with some containers.

Meanwhile, the channel part 100*b* is provided with a third channel 130 for mixing the emulsion formed in the second channel 120 with the thickener supplied from the fourth container 50. The third channel 130 may be provided in a form of being stacked with the first channel 110 and the second channel 120, and to this end, the third plate 16 on which the third channel 130 is formed may be disposed below the second plate 14, that is, at a position farthest from the containers 20, 30, 40, and 50. At this time, the tube 60 and the fourth flow path 52 may be extended penetrating through the first plate 12 and the second plate 14 toward the third plate 16.

Here, the third channel 130 may be provided to be in communication with other components so that a fluid can be discharged through the tube 60 after the fluid is discharged from the containers 20, 30, 40, and 50 by the pressure formed by the pump P and passes through the channel part 110*b*.

Specifically, the second channel 120 and the third channel 130 may be connected by the emulsion flow path 16, and the emulsion generated in the second channel 120 may be connected to the emulsion injection hole 131 of the third channel through the emulsion flow path 16. To this end, the second discharging hole 128 of the second channel 120 is connected to the emulsion flow path 16 rather than the tube 60.

Meanwhile, according to some embodiments, the third channel 130 may be formed on the same plane as the first channel 110 and the second channel 140, and in this case, the second discharging hole 128 of the second channel 120 may substantially correspond to the emulsion injection hole 131 of the third channel 130.

The third channel 130 may include: an emulsion injection hole 131 to which an emulsion generated in the second channel 120 is supplied; a thickener injection hole 133 connected to the fourth flow path 52 and supplied with a thickener; a third confluence portion 135 in which the emulsion provided through the emulsion injection hole 131 and the thickener provided through the thickener injection hole 133 meet each other; a thickener mixing portion 137 for advancing the emulsion and the thickener met at the third confluence portion 135 and mixing with each other; and a third discharging hole 139 connected to the tube 60 for discharging the emulsion mixed with the thickener.

The third channel 130 may be formed to have substantially the same structure as the first channel 110, and in this case, the shape and the structure of the emulsion injection hole 131, the thickener injection hole 133, the third confluence portion 135, the thickener mixing unit 137, and the third discharging hole 139 may correspond to, respectively, the internal fluid injection hole 111, the functional fluid injection hole 113, the first confluence portion 115, the mixing portion 117, and the first discharging hole 119, and therefore detailed descriptions thereof will be omitted. In the present embodiment, it has been described that the third channel 130 has the same structure as that of the first channel 110 as an example, but the spirit of the present invention is not limited thereto, and the third channel 130 may be a microfluidic channel of a different structure capable of mixing the emulsion and the thickener.

The emulsion and the thickener supplied to the third channel 130 may be sufficiently mixed with each other by vortices, centrifugal forces, and the like generated through the thickener mixing portion 137.

The emulsion mixed with the thickener in the thickener mixing portion 137 may be guided to the third discharging hole 139 and discharged to the pump P through the tube 60.

On the other hand, a neutralizer may be used depending on the acidity of the thickener. In this case, the neutralizing agent may be mixed with the external fluid and provided to the third container 40. Accordingly, the emulsion may have an acidity according to the neutralizer, and may neutralize the thickener by mixing with the thickener in the third channel 130. According to an embodiment, the neutralizing agent may be provided in admixture with the internal fluid.

According to the apparatus for manufacturing instantly emulsified cosmetics according to another embodiment of the present invention as described above, by adding a thickener to the emulsion after the emulsion is formed there is an advantage that can adjust the usability and stability of the emulsion.

Followings are a list of embodiments of the invention.

Item 1 is an apparatus for manufacturing instantly emulsified cosmetics comprising: a housing for forming an exterior; a pump provided in the housing for discharging an instantly emulsified emulsion to the outside of the housing; a first container provided in the housing for storing an internal fluid; a second container provided in the housing for storing a functional fluid including a functional raw material; a third container provided in the housing for storing an external fluid; a channel part provided in the housing for receiving the external fluid, the internal fluid and the functional fluid to generate an emulsion; and a tube for providing the pump with the emulsion generated in the channel part, wherein the channel part includes: a first channel for mixing the internal fluid and the functional fluid to generate a mixed fluid; and a second channel for mixing the mixed fluid provided from the first channel and the external fluid to generate an emulsion.

Item 2 is the apparatus according to Item 1, wherein the first channel and the second channel are disposed in the housing so as to be stacked on each other.

Item 3 is the apparatus according to Items 1 and 2, wherein the first channel is disposed closer to the first container, the second container, and the third container than the second channel.

Item 4 is the apparatus according to Items 1 to 3, further comprising: a first plate on which the first channel is formed; a second plate on which the second channel is formed; and a connecting flow path connecting the first plate and the second plate to supply the mixed fluid generated in the first channel to the second channel.

Item 5 is the apparatus according to Items 1 to 4, wherein the first channel and the second channel are disposed on the same plane.

Item 6 is the apparatus according to Items 1 to 5, further comprising: a first flow path for providing an internal fluid from the first container to the first channel; a second flow path for providing a functional fluid from the second container to the first channel; and a third flow path for providing an external fluid to the second channel from the third container.

Item 7 is the apparatus according to Items 1 to 6, wherein the first channel includes: an internal fluid injection hole connected to the first flow path; a functional fluid injection hole connected to the second flow path; a first confluence portion where the internal fluid provided to the internal fluid injection hole and the functional fluid provided to the functional fluid injection hole meet each other; a mixing portion which advances the internal fluid and the functional fluid that have met each other at the first confluence portion and which generates the mixed fluid; and a first discharging hole configured to provide the mixed fluid generated in the mixing portion to the second channel.

Item 8 is the apparatus according to Items 1 to 7, wherein the mixing portion is formed to make a vortex in the flow by switching the flow direction of the fluid.

Item 9 is the apparatus according to Items 1 to 8, wherein the mixing portion includes: a first rotation path for guiding an entering fluid to be rotated in one direction; a second rotation path for guiding the fluid rotating in one direction to be rotated in another direction; and a direction switching path for changing a rotational direction of the fluid between the first rotation path and the second rotation path.

Item 10 is the apparatus according to Items 1 to 9, wherein the second channel includes: an external fluid injection hole connected to the third flow path; a mixed fluid injection hole through which the mixed fluid supplied from the first channel is injected; a second confluence portion where the external fluid provided to the external fluid injection hole and the mixed fluid injected into the mixed fluid injection hole provided to the mixed fluid injection hole meet each other; an emulsifying part for emulsifying an external fluid and a mixed fluid met at the second confluence portion to generate an emulsion; and a discharging path for guiding an emulsion generated in the emulsifying part to a second discharging hole for providing it to the tube.

Item 11 is the apparatus according to Items 1 to 10, wherein the emulsifying part is configured such that the external fluid interrupts the flow of the mixed fluid such that the mixed fluid is dispersed in the external fluid into a particle state.

Item 12 is the apparatus according to Items 1 to 11, wherein the emulsifying part is an orifice disposed downstream of the second confluence portion.

Item 13 is the apparatus according to Items 1 to 12, wherein the functional fluid includes a vitamin derivative, and has an acidity at which the vitamin derivative is in a stable state, wherein the internal fluid is an aqueous solution having an acidity capable of neutralizing the functional fluid, and wherein the functional fluid is mixed with the internal fluid in the first channel to be neutralized.

Item 14 is the apparatus according to Items 1 to 13, wherein the functional fluid is a polyol in which vitamin C is dissolved, wherein the internal fluid is water, and wherein the functional fluid is mixed with the internal fluid in the first channel to be hydrated.

Item 15 is the apparatus according to Items 1 to 14, further comprising: a fourth container for storing a thickener; and a third channel for mixing the emulsion generated in the second channel with the thickener provided from the fourth container, wherein the tube is connected to the third channel to provide an emulsion mixed with a thickener to the pump.

Item 16 is the apparatus according to Items 1 to 15, wherein the third channel includes: an emulsion injection hole into which the emulsion provided from the second channel is injected; a thickener injection hole through which the thickener is injected; a third confluence portion where the emulsion provided to the emulsion injection hole and the thickener provided to the thickener injection hole meet each other; a thickener mixing portion for advancing the emulsion and the thickener met at the third confluence portion together and mixing them together; and a third discharging hole connected to the tube for discharging the emulsion containing the thickener.

Item 17 is the apparatus according to Items 1 to 16, wherein an internal fluid, a functional fluid, and an external fluid are supplied to the channel part by the pressure generated by the manipulation of the pump, thereby generating the emulsion, and the generated emulsion is supplied to the pump through the tube.

Item 18 is a method for manufacturing instantly emulsified cosmetics comprising the steps of: manipulating a pump provided in a housing by a user; mixing an internal fluid discharged from a first container provided in the housing and a functional fluid discharged from a second container provided in the housing by the manipulation of the pump to produce a mixed fluid in a first channel; creating an emulsion by mixing the mixed fluid generated in the first channel and an external fluid discharged from a third container together in a second channel to be instantly emulsified; and providing the emulsion generated in the second channel to the pump through a tube connected to the pump.

While the apparatus for manufacturing instantly emulsified cosmetics and the method therefor according to the embodiment of the present invention have been described as concrete embodiments, these are just examples, and the present invention should be construed in a broadest scope based on the fundamental ideas disclosed herein, rather than being limited to them. By combining or replacing a part or parts of embodiments disclosed herein, the ordinary skilled in the art may carry out a type of form which is not explicitly described herein, and however, it should be noted that it does not depart from the scope of the present invention. Besides, the ordinary skilled in the art may easily change or modify embodiments disclosed herein based on the disclosure, and however, it is obvious that such change or modification also falls within the scope of the present invention.

INDUSTRIAL APPLICABILITY

The present invention is applicable in the cosmetics industry.

The invention claimed is:

1. An apparatus for manufacturing instantly emulsified cosmetics comprising:

a housing for forming an exterior;

a pump provided in the housing for discharging an instantly emulsified emulsion to the outside of the housing;

a first container provided in the housing for storing an internal fluid;

a second container provided in the housing for storing a functional fluid including a functional raw material;

a third container provided in the housing for storing an external fluid;

a channel part provided in the housing for receiving the external fluid, the internal fluid and the functional fluid to generate an emulsion; and a tube for providing the pump with the emulsion generated in the channel part, wherein the channel part includes:

a first channel for mixing the internal fluid and the functional fluid to generate a mixed fluid; and a second channel for mixing the mixed fluid provided from the first channel and the external fluid to generate an emulsion, a first flow path for providing an internal fluid from the first container to the first channel;

a second flow path for providing a functional fluid from the second container to the first channel; and a third flow path for providing an external fluid to the second channel from the third container, wherein the first channel includes:

an internal fluid injection hole connected to the first flow path;

a functional fluid injection hole connected to the second flow path;

a first confluence portion where the internal fluid provided to the internal fluid injection hole and the functional fluid provided to the functional fluid injection hole meet each other;

a mixing portion which advances the internal fluid and the functional fluid that have met each other at the first confluence portion and which generates the mixed fluid; and a first discharging hole configured to provide the mixed fluid generated in the mixing portion to the second channel.

2. The apparatus of claim 1, wherein the first channel and the second channel are disposed in the housing so as to be stacked on each other.

3. The apparatus of claim 2, wherein the first channel is disposed closer to the first container, the second container, and the third container than the second channel.

4. The apparatus of claim 2, further comprising:

a first plate on which the first channel is formed;

a second plate on which the second channel is formed; and a connecting flow path connecting the first plate and the second plate to supply the mixed fluid generated in the first channel to the second channel.

5. The apparatus of claim 2, wherein the first channel and the second channel are disposed on the same plane.

6. The apparatus of claim 1, wherein the mixing portion is formed to make a vortex in the flow by switching the flow direction of the fluid.

7. The apparatus of claim 6, wherein the mixing portion includes:

a first rotation path for guiding an entering fluid to be rotated in one direction;

a second rotation path for guiding the fluid rotating in one direction to be rotated in another direction; and a direction switching path for changing a rotational direction of the fluid between the first rotation path and the second rotation path.

8. The apparatus of claim 1, wherein the second channel includes:

an external fluid injection hole connected to the third flow path;

a mixed fluid injection hole through which the mixed fluid supplied from the first channel is injected;

a second confluence portion where the external fluid provided to the external fluid injection hole and the mixed fluid injected into the mixed fluid injection hole provided to the mixed fluid injection hole meet each other;

an emulsifying part for emulsifying an external fluid and a mixed fluid met at the second confluence portion to generate an emulsion; and a discharging path for guiding an emulsion generated in the emulsifying part to a second discharging hole for providing it to the tube.

9. The apparatus of claim 8, wherein the emulsifying part is configured such that the external fluid interrupts the flow of the mixed fluid such that the mixed fluid is dispersed in the external fluid into a particle state.

10. The apparatus of claim 9, wherein the emulsifying part is an orifice disposed downstream of the second confluence portion.

11. The apparatus of claim 1, wherein the functional fluid includes a vitamin derivative, and has an acidity at which the vitamin derivative is in a stable state, wherein the internal fluid is an aqueous solution having an acidity capable of neutralizing the functional fluid, and wherein the functional fluid is mixed with the internal fluid in the first channel to be neutralized.

12. The apparatus of claim 1, wherein the functional fluid is a polyol in which vitamin C is dissolved, wherein the internal fluid is water, and wherein the functional fluid is mixed with the internal fluid in the first channel to be hydrated.

13. The apparatus of claim 1, further comprising:

a fourth container for storing a thickener; and a third channel for mixing the emulsion generated in the second channel with the thickener provided from the fourth container, wherein the tube is connected to the third channel to provide an emulsion mixed with a thickener to the pump.

14. The apparatus of claim 13, wherein the third channel includes:

an emulsion injection hole into which the emulsion provided from the second channel is injected;

a thickener injection hole through which the thickener is injected;

a third confluence portion where the emulsion provided to the emulsion injection hole and the thickener provided to the thickener injection hole meet each other;

a thickener mixing portion for advancing the emulsion and the thickener met at the third confluence portion together and mixing them together; and a third discharging hole connected to the tube for discharging the emulsion containing the thickener.

15. The apparatus of claim 1, wherein an internal fluid, a functional fluid, and an external fluid are supplied to the channel part by the pressure generated by the manipulation of the pump, thereby generating the emulsion, and the generated emulsion is supplied to the pump through the tube.

* * * * *